US007937905B2

(12) United States Patent
Fox et al.

(10) Patent No.: US 7,937,905 B2
(45) Date of Patent: May 10, 2011

(54) TAPE GUIDE PLATE AND FINGER PLATE WITH INTEGRAL ROLLERS

(75) Inventors: Bryce J. Fox, Honesdale, PA (US); William J. Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 132 days.

(21) Appl. No.: 12/379,009

(22) Filed: Feb. 11, 2009

(65) Prior Publication Data

US 2009/0217621 A1 Sep. 3, 2009

Related U.S. Application Data

(60) Provisional application No. 61/064,371, filed on Feb. 29, 2008.

(51) Int. Cl.
*B65B 51/06* (2006.01)
*B31B 1/72* (2006.01)

(52) U.S. Cl. ..... 53/136.4; 156/461; 156/486; 156/492; 493/117

(58) Field of Classification Search ..... 53/135.1, 53/136.1, 136.3, 136.4, 376.2, 376.3, 377.2, 53/378.3; 156/459, 461, 468, 475, 477.1, 156/486–489, 492; 493/116, 117; *B65B 51/06*
See application file for complete search history.

(56) References Cited

U.S. PATENT DOCUMENTS

| | | | | | |
|---|---|---|---|---|---|
| 2,052,903 | A * | 9/1936 | Stagmeler | 156/468 |
| 2,787,396 | A * | 4/1957 | Christensson | 156/477.1 |
| 2,906,426 | A * | 9/1959 | Fritzinger | 156/468 |
| 4,039,367 | A * | 8/1977 | Warshaw et al. | 156/486 |
| 4,238,269 | A * | 12/1980 | Deering, Jr. | 156/468 |
| 4,382,836 | A * | 5/1983 | Frank | 156/459 |
| 4,642,157 | A * | 2/1987 | Cavanagh | 156/468 |
| 5,228,943 | A * | 7/1993 | Vasilakes | 156/468 |
| 5,824,183 | A * | 10/1998 | Crankshaw | 156/486 |
| 6,571,848 | B2 * | 6/2003 | Tsuken et al. | 156/468 |
| 2009/0064635 | A1 * | 3/2009 | Chiu Chen | 53/136.3 |

FOREIGN PATENT DOCUMENTS

| | | | |
|---|---|---|---|
| DE | 19704679 | A1 * | 8/1997 |
| EP | 647563 | A1 * | 4/1995 |
| JP | 05330723 | A * | 12/1993 |
| JP | 2000109026 | A * | 4/2000 |
| JP | 2004276951 | A * | 10/2004 |

* cited by examiner

*Primary Examiner* — Stephen F Gerrity
(74) *Attorney, Agent, or Firm* — Law Offices of Steven W. Weinrieb

(57) ABSTRACT

A tape guide plate and finger plate assembly for the leading end portion of the carton or case sealing tape is provided in order to effectively prevent the leading end portion of the carton or case sealing tape from folding over upon itself whereby the adhesive material, disposed upon the front side surface portion of the sealing tape would effectively become stuck to itself and thereby foul further carton or case seal-ing operations. In addition, rollers are provided upon a finger plate so as to permit the sealing tape to be dispensed in a substantially frictionless or drag-free manner.

19 Claims, 2 Drawing Sheets

TAPE GUIDE PLATE AND FINGER PLATE WITH INTEGRAL ROLLERS

CROSS-REFERENCE TO RELATED PATENT APPLICATIONS

This patent application is related to, based upon, and effectively a utility patent application conversion of U.S. Provisional Patent Application Ser. No. 61/064,371 which was filed on Feb. 29, 2008, the date benefits of which are hereby claimed and the entirety of which is incorporated herein by reference to the extent permitted by law.

FIELD OF THE INVENTION

The present invention relates generally to carton or case sealing apparatus, and more particularly to a new and improved tape guide plate and finger plate assembly for the leading end portion of the carton or case sealing tape in order to effectively prevent the leading end portion of the carton or case sealing tape from folding over upon itself whereby the adhesive material, disposed upon the front side surface portion of the sealing tape would effectively become stuck to itself and thereby foul further carton or case sealing operations. In addition, rollers are provided upon a finger plate so as to permit the sealing tape to be dispensed in a substantially frictionless or drag-free manner.

BACKGROUND OF THE INVENTION

In connection with carton or case sealing machines or apparatus, it is desirable that, for example, the leading end portion of the carton or case sealing tape does not, in effect, fold over onto itself whereby the adhesive material, disposed upon the front side surface portion of the sealing tape, would effectively become stuck to itself and thereby foul further carton or case sealing operations. In addition, it is also desirable that the carton or case sealing tape be dispensed in a manner which effectively prevents any substantial amount of drag forces from being impressed thereon which would not only lead, for example, to inconsistent tape application parameters, but in addition, could cause tearing, breakage, or other mutilation or deformation of the carton or case sealing tape.

A need therefore exists in the art for a new and improved tape guide plate and finger plate assembly for the leading end portion of the carton or case sealing tape of a carton or case sealing machine or apparatus so as to permit the leading end portion of the carton or case sealing tape, as well as upstream portions thereof being dispensed by means of the tape dispensing cartridge assembly, to be dispensed in a substantially frictionless or drag-free manner and which also effectively prevents the carton or case sealing tape from folding over upon itself so as not to adhere to itself and thereby foul further carton or case sealing operations.

SUMMARY OF THE INVENTION

The foregoing and other objectives are achieved in accordance with the teachings and principles of the present invention through the provision of a new and improved tape guide plate and finger plate assembly for the leading end portion of the carton or case sealing tape of a carton or case sealing machine or apparatus wherein the tape guide plate is provided with a centrally located, elongated bump or protrusion, and the finger plate comprises a pair of laterally spaced fingers which are adapted to engage surface portions of the tape guide plate which are disposed upon opposite sides of the centrally located elongated bump or protrusion as a result of the tape guide plate and the finger plate being spring-biased toward each other. In this manner, the finger plate cooperates with the tape guide plate so as to effectively form a creased or bowed section within the leading end portion of the carton or case sealing tape so as to thereby prevent the same from folding over upon itself and likewise preventing the adhesive surface portion thereof from being adhered together. In addition, the distal end portions of the fingers of the finger plate have rollers disposed thereon so as to facilitate the smooth movement of the carton or case sealing tape during the carton or case sealing tape dispensing operations in a relative frictionless or drag-free manner.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
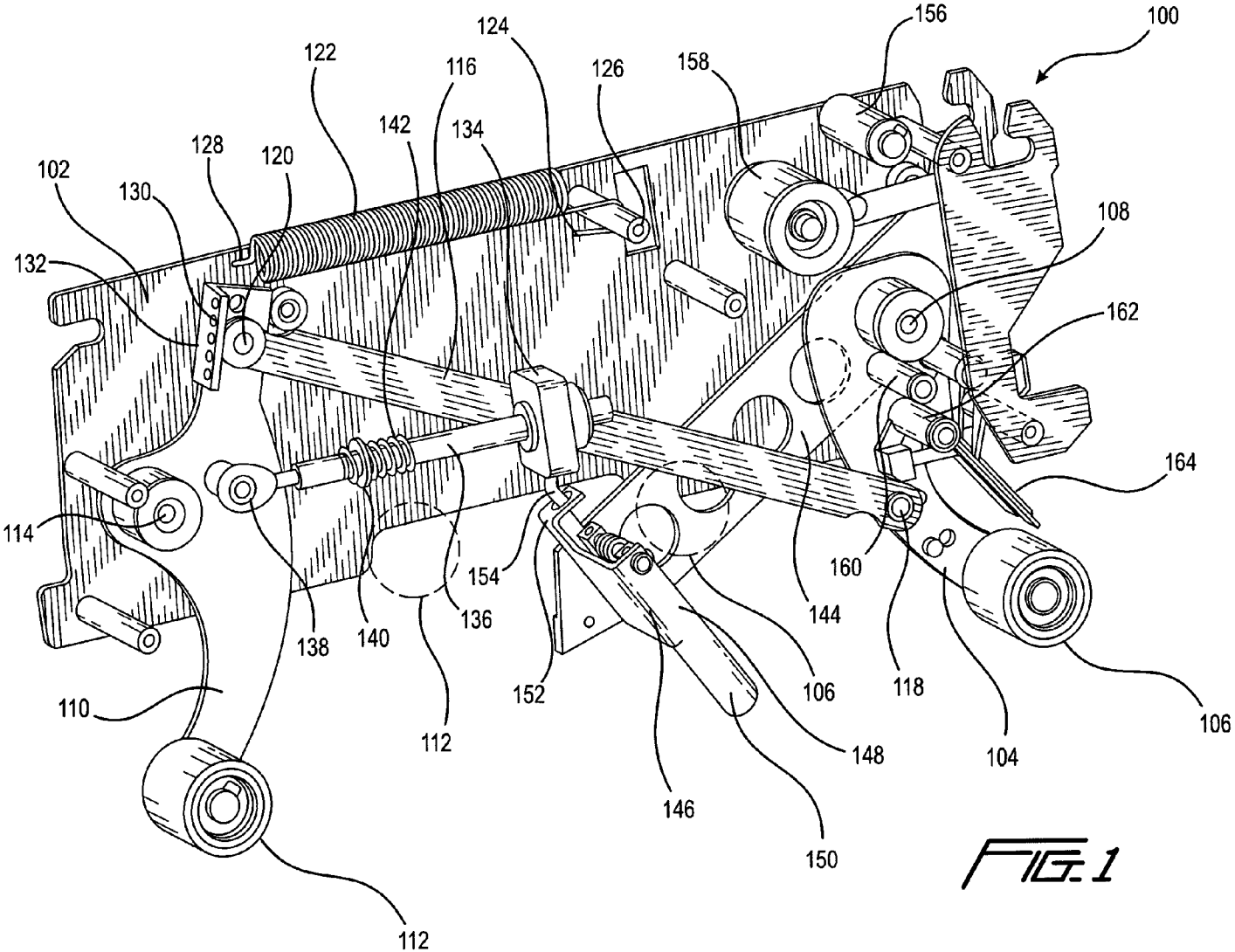
FIG. 1 is a perspective view of an overall carton or case sealing front and rear tape roller application system for use within a carton or case sealing machine and within which the new and improved tape guide plate and finger plate assembly is adapted to be provided or incorporated in order to permit the leading end portion of the carton or case sealing tape of the carton or case sealing machine or apparatus, as well as upstream portions thereof being dispensed by means of the tape dispensing cartridge assembly, to be dispensed in a substantially frictionless or drag-free manner and which also effectively prevents the carton or case sealing tape from folding over upon itself so as not to adhere to itself and thereby foul further carton or case sealing operations.

Referring now to the drawings, and more particularly to FIG. 1 thereof, an overall carton or case sealing front and rear tape roller application system, within which the new and improved tape guide plate and finger plate assembly is adapted to be provided or incorporated in order to permit the leading end portion of the carton or case sealing tape of the carton or case sealing machine or apparatus, as well as upstream portions thereof being dispensed by means of the tape dispensing cartridge assembly, to be dispensed in a substantially frictionless or drag-free manner and which also effectively prevents the carton or case sealing tape from folding over upon itself so as not to adhere to itself and thereby foul further carton or case sealing operations, is disclosed and is generally indicated by the reference character 100. More particularly, it is seen that the overall carton or case sealing front and rear tape roller application system 100 comprises a main mounting plate 102 by means of which a spring tension control system, more particularly disclosed within co-pending patent application entitled SPRING TENSION CONTROL SYSTEM FOR THE TAPE APPLICATION ROLLERS OF A TAPE ROLL DISPENSING CARTRIDGE ASSEMBLY, Ser. No. 12/073,143, filed on Feb. 29, 2008, is mounted upon the framework of the carton or case sealing machine. A first front application roller arm 104, upon the lower end portion of which is mounted a front carton or case sealing tape application roller 106 for applying the sealing tape to the vertically oriented front surface portion of the carton or case, is pivotally mounted upon the main mounting plate 102 by means of a first pivot pin assembly 108, and a second rear application roller arm 110, upon the lower end portion of which is mounted a rear carton or case sealing tape application roller 112 for applying the sealing tape to the vertically oriented rear surface portion of the carton or case, is pivotally mounted upon the main mounting plate 102 by means of a second pivot pin assembly 114.

A link bar 116 has a first end portion thereof pivotally connected to a central portion of the first front application roller arm 104 as at 118, while a second opposite end portion of the link bar 116 is pivotally connected to an upper end portion of the second rear application roller arm 110 as at 120 such that the link bar 116 operatively interconnects the first front and second rear application roller arms 104,110 together. Accordingly, it can be appreciated that when, for example, the front carton or case sealing tape application roller 106, mounted upon the first front application roller arm 104, encounters the vertically oriented front surface portion of the carton or case to be sealed with the sealing tape, the front carton or case sealing tape application roller 106 will initially be effectively pushed, by means of the vertically oriented front surface portion of the carton or case, toward the left, as viewed within FIG. 1, such that as a result of the pivotal movement of the first front application roller arm 104, in the clockwise direction, around its pivot axis as defined by means of its pivot pin assembly 108, the front carton or case sealing tape application roller 106 will effectively be moved along an arcuate path from its original or start position, as illustrated in solid lines within FIG. 1, to an end of movement position, as is illustrated in dotted lines within FIG. 1. Simultaneously therewith, it can be readily appreciated that, as a result of the aforenoted operative interconnection defined between the first front application roller arm 104 and the second rear application roller arm 110 by means of the link bar 116, the second rear application roller arm 110 will be pivotally moved in a counterclockwise direction around its pivot axis, as defined by means of its pivot pin assembly 114, such that the upper end portion of the second rear application roller arm 110 will be moved toward the left as viewed within FIG. 1 while the lower end portion of the second rear application roller arm 110, upon which is mounted the rear carton or case sealing tape application roller 112, such that the rear carton or case sealing tape application roller 112 will effectively be moved along an arcuate path from its original or start position, as illustrated in solid lines within FIG. 1, to an end of movement position, as is illustrated in dotted lines within FIG. 1.

It is also seen that a first spring-biasing means, in the form of a coil spring 122, has a first end portion 124 engaged with a mounting pin 126 which is fixedly mounted upon the main mounting plate 102, while a second opposite end portion 128 of the first spring-biasing means 122 is adapted to be engaged within any one of, for example, five apertures 130 defined within a bracket 132 which is integrally mounted upon the second rear application roller arm 110. It is to be noted in connection with the first spring biasing means 122, and the connection of its second end portion 128 to the bracket 132 mounted upon the second rear application roller arm 110, that the provision of, for example, the five different apertures 130 defined within the bracket 132 permits the actual tension of the first spring-biasing means 122 to be operatively adjusted as desired.

In this manner, when the first front application roller arm 104 and the second rear application roller arm 110 are pivotally moved from their original positions, at which the front carton or case sealing tape application roller 106 and the rear carton or case sealing tape application roller 112 are respectively illustrated by means of solid lines within FIG. 1, to their end of movement positions at which the front carton or case sealing tape application roller 106 and the rear carton or case sealing tape application roller 112 are respectively illustrated by means of dotted lines within FIG. 1, the first spring biasing means 122 will be expanded whereby the same will cause the first front application roller arm 104 and the second rear application roller arm 110, upon which the front carton or case sealing tape application roller 106 and the rear carton or case sealing tape application roller 112 are respectively mounted, to be returned to their original or start positions, as illustrated by means of the solid lines within FIG. 1, when the first spring biasing means 122 is permitted to contract back to its original state, as illustrated within FIG. 1, at a predetermined point of time of the tape sealing operational cycle as will be explained more fully hereinafter.

Continuing further, it is seen that a slide block 134 is movably mounted upon a guide rod 136, and that the left end portion of the guide rod 136 is pivotally connected to a substantially central portion of the second rear application roller arm 110 by means of a pivot pin assembly 138. The slide block 134 is pivotally connected to the link bar 116 by means of a pivot pin, not visible, which projects outwardly from, in effect, the back side of the slide block 134 so as to be disposed within an aperture, also not visible, which is defined within the link bar 116. In this manner, the slide block 134 is movable, along with the link bar 116, from its original or start position, as illustrated within FIG. 1, to an end of movement position when the link bar 116 is itself moved from its original or start position as illustrated within FIG. 1 to its end of movement position which correlates with the angular or pivotal movements of the first front application roller arm 104 and the second rear application roller arm 110 having the front carton or case sealing tape application roller 106 and the rear carton or case sealing tape application roller 112 respectively mounted thereon, as has been previously described. Still yet further, it is also seen that a stop member 140, in the form of, for example, a washer, is fixedly secured at a predetermined location upon the guide rod 136, and a second spring biasing means 142, in the form of a coil spring, is fixedly disposed upon the guide rod 136 as a result of effectively having several coils thereof being operatively engaged with the stop member or washer 140.

Accordingly, when the slide block 134 is moved toward the left, as viewed within FIG. 1, from its original or start position to its end of movement position adjacent to the stop member or washer 140, the second spring biasing means 142 will be compressed so as to exert an increased or enhanced amount of biasing force, pressure, or tension upon the second rear application roller arm 110 for an operational purpose that will be explained more fully hereinafter. It is lastly noted that a knife support arm 144, as more fully described within co-pending patent application entitled QUICK CHANGE KNIFE BLADE ASSEMBLY FOR A TAPE ROLL DISPENSING CARTRIDGE ASSEMBLY OF A CASE SEALING MACHINE, Ser. No. 12/073,138, filed Feb. 29, 2008, is also pivotally mounted upon the main mounting plate 102, wherein the knife support arm 144 is adapted to have a downwardly extending or dependent knife blade or cutting member 146 fixedly mounted thereon, the knife support arm 144 being biased in a downward mode by a spring-biasing means, not shown, such that the knife support arm 144 is normally disposed at its lowered position as illustrated within FIG. 1. A knife blade guard or cover 148 is pivotally mounted upon the knife support arm 144 so as to be movable between a first position at which the knife blade guard or cover 148 covers the knife blade or cutting member 146 so as to protect operator or maintenance personnel, and a second position at which the knife blade guard or cover 148 effectively uncovers the knife blade or cutting member 146 so as to permit the knife blade or cutting member 146 to cut the sealing tape in order to, for example, effectively define a rear tab portion of the sealing tape which is adapted to be applied, by means of a wiping operation, onto the vertically oriented rear surface portion of the carton or case by means of the rear carton or case sealing tape application roller 112.

The knife blade guard or cover 148 is provided with a dependent tab member 150 which is adapted to be engaged by the carton or case to be sealed, as the carton or case is being moved along its tape sealing path, so as to effectively move the knife guard or cover 148 from its first position, at which the knife blade guard or cover 148 covers the knife blade or cutting member 146, to its second position at which the knife blade guard or cover 148 effectively uncovers the knife blade or cutting member 146, and it is also noted that the knife blade guard or cover 148 is also provided with an upstanding bracket member 152 within which there is defined an aperture, not clearly visible within FIG. 1. Correspondingly, the slide block 134 is provided with a dependent lug member 154 which is adapted to be engaged within the aperture, not visible, which is defined within the upstanding bracket member 152 when the slide block 134 is disposed at its original or start position as illustrated within FIG. 1. In this manner, the knife blade guard or cover 148 is effectively prevented from being moved from its covered position with respect to the knife blade or cutting member 146 to its uncovered position with respect to the knife blade or cutting member 146 at an inappropriate time of the carton or case sealing operational cycle.

Alternatively, when the slide block 134 is moved toward the left from its original or start position to its end of movement position, as viewed within FIG. 1, such as, for example, when the link bar 116 is moved from its original or start position, as illustrated within FIG. 1, to its end of movement position in correlation with the angular or pivotal movements of the first front application roller arm 104 and the second rear application roller arm 110, having the front carton or case sealing tape application roller 106 and the rear carton or case sealing tape application roller 112 respectively mounted thereon, as has been previously described, the lug member 154 will be disengaged from the aperture, not visible, defined within the upstanding backet member 152 of the knife blade guard or cover 148. In this manner, the knife blade guard or cover 148 will be permitted to be moved to its uncovered position with respect to the knife blade or cutting member 146 so as to, in turn, permit the knife blade or cutting member 146 to perform its sealing tape cutting function at the predetermined point in time of the carton or case sealing operation.

Having described the aforenoted structural components comprising the overall carton or case sealing front and rear tape roller application system 100, a brief operational cycle of the overall carton or case sealing front and rear tape roller application system 100 will now be described. More particularly, it is firstly noted that a leading end tab portion of the carton or case sealing tape is adapted to be routed, for example, from a tape supply roll, not shown, around a right external peripheral side surface portion of a first idler roller 156, beneath a lower external peripheral surface portion of the first idler roller 156, over an upper external peripheral surface portion of a second idler roller 158, and around a left external peripheral side surface portion of the second idler roller 158. From the second idler roller 158, the leading end tab portion of the carton or case sealing tape is conducted between third and fourth idler rollers 160,162 so as to effectively be conducted onto a guide plate 164 such that the free end portion of the leading end tab portion of the carton or case sealing tape will be disposed upon or alongside the right external peripheral side surface portion of the front carton or case sealing tape application roller 106. In this manner, the leading end tab portion of the carton or case sealing tape will effectively be interposed or sandwiched between the right external peripheral side surface portion of the front carton or case sealing tape application roller 106 and the vertically oriented front surface portion of the carton or case, when the vertically oriented front surface portion of the carton or case engages the front carton or case sealing tape application roller 106.

Subsequently, as the carton or case is then conveyed in the conveyance direction, which extends from right to left as viewed within FIG. 1, the front carton or case sealing tape application roller 106 will, in effect, be forced toward the left, as viewed within FIG. 1, and will also begin to move upwardly along the vertically oriented front surface portion of the carton or case, as the conveyed carton or case effectively pushes the front carton or case sealing tape application roller 106 out of its way whereby the front carton or case sealing tape application roller 106 will effectively apply the leading end tab portion of the carton or case sealing tape onto the vertically oriented front surface portion of the carton or case by means of a wiping action. As a result of the aforenoted movement of the front carton or case sealing tape application roller 106, the first front application roller arm 104 will be forced to rotate in the clockwise direction around its pivot pin assembly 108 thereby causing the link bar 116 to effectively be moved toward the left and to be simultaneously rotated a predetermined amount, in the counterclockwise direction, around a pivot axis effectively defined by means of its connection to the slide block 134 and as respectively permitted by means of the pivotal connections 118,120 defined between the opposite ends of the link bar 116 and the first and second front and rear application roller arms 104,110.

In addition, since the second rear application roller arm 110 is operatively connected to the first front application roller arm 104 by means of the link bar 116, the second rear application roller arm 110 will be pivoted or rotated in the counterclockwise direction around its pivot pin assembly 114 whereby the second carton or case sealing tape application roller 112 will begin to move upwardly and toward the first carton or case sealing tape application roller 106 until both of the front and rear carton or case sealing tape application rollers 106,112 ultimately reach their end of movement positions, as illustrated by means of the dotted lines within FIG. 1, at which point in time the front carton or case sealing tape application roller 106 will be disposed upon the horizontally oriented upper surface portion of the carton or case while the second carton or case sealing tape application roller 112 will be disposed at a position which is spaced just above the upper surface portion of the carton or case. As a result of such movements, the front carton or case sealing tape application roller 106 will also be able to wipe the carton or case sealing tape along the upper surface portion of the carton or case in the direction extending from the vertically oriented front surface portion of the carton or case toward the vertically oriented rear surface portion of the carton or case as the carton or case is being continuously conveyed along its conveyance path which is now, in effect, disposed beneath the front and rear carton or case sealing tape application rollers 106,112.

It is also to be noted at this point in time that in view of the substantially leftward movement of the link bar 116, and its operative connection to the slide block 134, the slide block 134 will be moved along the guide rod 136 such that the dependent lug member 154 of the slide block 134 will be disengaged from the aperture formed within the bracket member 152 of the knife blade guard or cover 148. In this manner, as the carton or case is being conveyed along its conveyance path, the upper portion of the vertically oriented front surface portion of the carton or case will encounter the tab member 150 of the knife blade guard or cover 148 so as to effectively pivot the same to its uncovered position thereby uncovering or exposing the knife blade or cutting member 146. In addition, the vertically oriented front surface portion of the carton or case will also encounter the knife support arm 144 so as to effectively move the same, along with the knife blade or cutting member 146 and the knife blade guard or cover 148 mounted thereon, to an elevated position, against its spring-biasing means, for a purpose to be explained hereinafter and which is also described within the aforenoted copending patent application entitled QUICK CHANGE KNIFE BLADE ASSEMBLY FOR A TAPE ROLL DISPENSING CARTRIDGE ASSEMBLY OF A CASE SEALING MACHINE.

Subsequently, as the front carton or case sealing tape application roller 106 approaches the upper rear edge portion of the carton or case, and in view of the fact that the front carton or case sealing tape application roller 106 is disposed at its dotted line position as illustrated within FIG. 1, whereby the front carton or case sealing tape application roller 106 is seen to be disposed immediately adjacent to the uncovered or exposed knife blade or cutting member 146, the front carton or case sealing tape application roller 106 will, in effect, fall off or be disengaged from the upper surface portion of the carton or case, and immediately thereafter, the knife support arm 144 will likewise, in effect, fall off or be disengaged from the upper surface portion of the carton or case. In view of the aforenoted spring-biasing of the knife support arm 144, the knife support arm 144 will now be biased back toward its original lowered position as illustrated within FIG. 1, whereby the knife blade or cutting member 146 can cut or sever the carton or case sealing tape thereby forming a rear tab portion of the carton or case sealing tape which is to be applied along the vertically oriented rear surface portion of the carton or case by means of a wiping action performed by means of the rear carton or case sealing tape application roller 112. It is to be noted that since both the front carton or case sealing tape application roller 106 and the knife support arm 144 are no longer engaged with or disposed upon the upper surface portion of the carton or case being sealed, the rear carton or case sealing tape application roller 112 is able to, in effect, be lowered into engagement with the upper surface portion of the carton or case being sealed.

In this manner, the rear carton or case sealing tape application roller 112 can perform its sealing function with respect to rear tab portion of the carton or case sealing tape along the vertically oriented rear surface portion of the carton or case. It is also to be noted that since the rear carton or case sealing tape application roller 112 is at this point in time disposed at its dotted line position, as illustrated within FIG. 1, whereby the rear carton or case sealing tape application roller 112 will also be disposed immediately adjacent to the left end portion of the knife support arm 144 and the knife blade or cutting member 146, then when the knife support arm 144 and the knife blade or cutting member 146 move to their lowered positions at which the knife blade or cutting member 146 cuts or severs the sealing tape in order to form the aforenoted rear tab portion of the sealing tape, the rear carton or case sealing tape application roller 112 will be substantially disposed at the upper rear edge or corner region of the carton or case. Still further, in view of the aforenoted disengagement of the front carton or case sealing tape application roller 106 from the upper surface portion of the carton or case, and the commencement of the downward movement thereof through, in effect, its return stroke or movement between its dotted line position and its solid line position, the second spring biasing means 142, which is disposed upon the guide rod 136 and which was previously compressed by means of the slide block 134 when the slide block 134 was moved from its rightwardmost position, illustrated within FIG. 1, to its leftwardmost position adjacent to the stop member 140, will now tend to expand back toward its normally non-compressed state. It is interesting to note, however, that the expansion of the second spring-biasing means 142 back toward its normally non-compressed state does not directly cause the second rear application roller arm 110 to move with an in-creased or enhanced amount of speed in the clockwise direction so as to, in turn, cause the rear carton or case sealing tape application roller 112 to rapidly move toward the left and back to its original position, as illustrated in solid lines as viewed within FIG. 1, so as to rapidly engage and apply the rear tab portion of the sealing tape onto the vertically oriented rear surface portion of the carton or case by means of the aforenoted wiping action. In fact, such rapid clockwise movement of the second rear application roller arm 110, and the consequent rapid leftward movement of the rear carton or case sealing tape application roller 112, is accomplished, in effect, indirectly as a result of the expansion of the second spring-biasing means 142.

More particularly, when the rear carton or case sealing tape application roller 112 is disposed at its dotted line position as illustrated within FIG. 1, the pivot pin assembly 138, operatively connecting the left end portion of the guide rod 136 to the second rear application roller arm 110, will, in effect, be disposed above the pivot pin assembly 114, by means of which the second rear application roller arm 110 is pivotally mounted upon the main mounting plate 102, as a result of the angular movement of the second rear application roller arm 110 around its pivot pin assembly 114 as the rear carton or case sealing tape application roller 112 is moved from its original solid line position as illustrated within FIG. 1 to its dotted line position as illustrated within FIG. 1. Accordingly, when the second spring biasing means 142 undergoes its expansion, if the expansion force of the same was directed toward the left so as to be imparted directly toward the second rear application roller arm 110, as viewed in FIG. 1, it would be oriented along a direction which would not in fact tend to move the second rear application roller arm 110 in the clockwise direction so as to in fact return the second rear application roller arm 110, and the rear carton or case sealing tape application roller 112 to its original solid line position.

In fact, therefore, the expansion force of the second spring biasing means 142 operates or acts, in effect, in conjunction with the contraction forces of the first spring biasing means 122, which was previously expanded when the front and rear carton or case sealing tape application rollers 106,112 were moved from their solid line positions to their dotted line positions as illustrated within FIG. 1, so as to be quickly imparted to and impressed upon the slide block 134 in order to quickly move the same along the guide rod 136 back toward its original position, as illustrated within FIG. 1. In this manner, the link bar 116 will be rapidly returned to its original position, as illustrated within FIG. 1, under the influence of both the contraction force of the first spring-biasing means 122 and the expansion force of the second spring-biasing means 142, such that the left end portion of the link bar 116, which is pivotally connected to the upper end portion of the second rear application roller arm 110, will, in effect, act upon the upper end portion of the second rear application roller arm 110 so as to cause the same to be rapidly rotated in the clockwise direction so as to in fact rapidly move the rear carton or case sealing tape application roller 112 in the leftward direction, back toward its original position as illustrated within FIG. 1, for its rapid engagement with the rear tab portion of the sealing tape in order to quickly and properly apply the same onto the vertically oriented rear surface portion of the carton or case being sealed.

Figure 2:
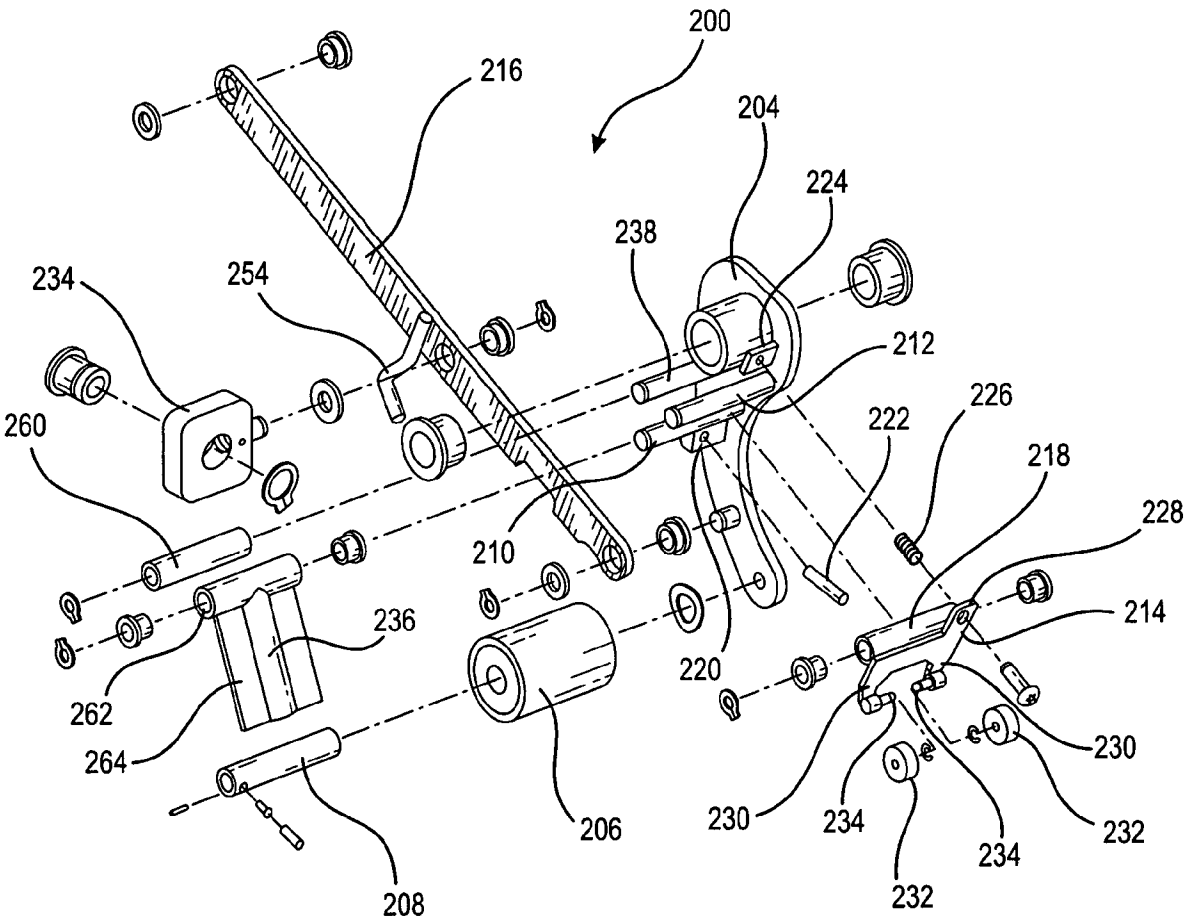
FIG. 2 is an exploded view of the new and improved tape guide plate and finger plate assembly, as constructed in accordance with the principles and teachings of the present invention and showing the cooperative parts thereof, incorporated within the overall carton or case sealing front and rear tape roller application system as disclosed within FIG. 1, for facilitating the leading end portion of the carton or case sealing tape of the carton or case sealing machine or apparatus, as well as upstream portions thereof being dispensed by means of the tape dispensing cartridge assembly, to be dispensed in a substantially frictionless or drag-free manner and which also effectively prevents the carton or case sealing tape from folding over upon itself so as not to adhere to itself and thereby foul further carton or case sealing operations.

Having described the aforenoted structural components of the overall carton or case sealing front and rear tape roller application system 100, and the operation thereof, the new and improved tape guide plate and finger plate assembly, for use in connection or incorporation within the overall carton or case sealing front and rear tape roller application system 100 as illustrated within FIG. 1, is now disclosed within FIG. 2 and is generally indicated by the reference character 200. It is noted that component parts illustrated within FIG. 2, which correspond to component parts illustrated in FIG. 1, will be designated by corresponding reference characters except that they will be within the 200 series. Referring then more particularly to FIG. 2 of the drawings, the new and improved tape guide plate and finger plate assembly for the leading end portion of the carton or case sealing tape of a carton or case sealing machine or apparatus, as constructed in accordance with the principles and teachings of the present invention and showing the cooperative parts thereof, is disclosed and is generally indicated by the reference character 200.

More particularly, it is seen that new and improved tape guide plate and finger plate assembly 200 for the leading end portion of the carton or case sealing tape of a carton or case sealing machine or apparatus comprises the front sealing tape application roller 206 which is adapted to be rotatably mounted upon a roller shaft 208 which, in turn, is adapted to be fixedly mounted upon the lower end portion of the front sealing tape application roller arm 204. The roller arm 204 is provided with a first transversely oriented shaft 210 upon which there is adapted to be pivotally mounted the tape guide plate 264 by means of the first sleeve member or idler roller 262, and a second transversely oriented shaft 212 upon which there is adapted to be pivotally mounted a finger plate 214 by means of a second sleeve member 218. A first spring mounting block 220 is mounted upon a central portion of the front sealing tape application roller arm 204 such that a first end portion of a first biasing spring 222 can be seated upon the application roller arm 204 as a result of being disposed within a bore of the first spring mounting block 220, while a second end portion of the first biasing spring 222 is adapted to be operatively engaged with the back or rear surface portion of the tape guide plate 264 so as to effectively bias the tape guide plate 264 in a first direction substantially away from the carton or case sealing tape application roller 206 and toward the finger plate 214 such that the carton or case sealing tape will be properly routed toward the carton or case sealing tape application roller 206 as will be more fully apparent hereinafter.

In a similar manner, a second spring mounting block 224 is mounted upon an upper portion of the front sealing tape application roller arm 204 such that a first end portion of a second biasing spring 226 can be seated upon the front sealing tape application roller arm 204 as a result of being disposed within a bore of the second spring mounting block 224, while a second end portion of the second biasing spring 226 is adapted to be engaged within an upper ear or lug portion 228 of the finger plate 214 so as to effectively bias the lower finger portions 230 of the finger plate 214 into engagement with the tape guide plate 264. It is to be noted that the distal end portions of the lower finger portions 230 of the finger plate 214 are provided with rollers 232 which are adapted to be mounted upon oppositely disposed trunnions or spindles 234 which are oriented toward each other, and that the central portion of the tape guide plate 264 is provided with an elongated bump or protrusion portion 236.

Accordingly, in view of the fact that the finger plate 214 is biased into engagement with the tape guide plate 264 by means of the second biasing spring 226 and that the tape guide plate 264 is likewise biased into engagement with the finger plate 214 by means of the first biasing spring 222, the finger portions 230 of the finger plate 214 will be disposed upon opposite sides of the centrally located bump or protrusion 236 so as to effectively facilitate the definition of a bowed or creased portion within the carton or case sealing tape which effectively provides the same with an enhanced amount of longitudinal rigidity and thereby effectively prevent the same from folding over upon itself such that opposite portions thereof do not become adhered to each other. In addition, the provision of the rollers 232 upon the finger plate 214 permit the carton or case sealing tape to be dispensed during a carton or case tape sealing cycle in a substantially smooth, frictionless or drag-free manner so as to permit consistent and proper application of the sealing tape to the cartons or cases and without risking any tearing of the carton or case sealing tape. It is also noted that the idler roller 260 is mounted upon a third transversely oriented shaft 238, mounted upon the central portion of the front sealing tape application roller arm 204, so as to define the sealing tape routing path as has been discussed in connection with the discussion of the overall system disclosed within FIG. 1.

Thus, it may be seen that that in accordance with the teachings and principles of the present invention, there has been provided a new and improved tape guide plate and finger plate assembly for the leading end portion of the carton or case sealing tape of a carton or case sealing machine or apparatus so as to permit the leading end portion of the carton or case sealing tape, as well as upstream portions thereof being dispensed by means of the tape dispensing cartridge assembly, to be dispensed in a substantially frictionless or drag-free manner and which also effectively prevents the carton or case sealing tape from folding over upon itself so as not to adhere to itself and thereby foul further carton or case sealing operations.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A tape guide plate and finger plate assembly for guiding a leading end portion of a carton or case sealing tape, within a carton or case sealing apparatus, comprising:

a sealing tape application roller;

a tape guide plate;

a finger plate pivotally mounted at a first proximal end portion thereof, and having at least one finger disposed upon a second distal end portion thereof;

a spring for biasing said finger plate toward said tape guide plate such that said at least one finger of said finger plate is moved into engagement with said tape guide plate such that a leading end portion of the carton or case sealing tape is interposed and conveyed between said tape guide plate and said at least one finger of said finger plate and guided toward said sealing tape application roller; and at least one roller disposed upon said at least one finger of said finger plate and operatively engaged with said tape guide plate for smoothly guiding the leading end portion of the carton or case sealing tape toward said sealing tape application roller for deposition onto a surface portion of a carton or case to be sealed, as the sealing tape is conveyed between said at least one roller, mounted upon said at least one finger of said finger plate, and said tape guide plate.

2. The tape guide plate and finger plate assembly as set forth in claim 1, wherein:

said sealing tape application roller is a front roller of a carton or case sealing application roller assembly.

3. The tape guide plate and finger plate assembly as set forth in claim 1, wherein:

said tape guide plate has a centrally located bump disposed thereon for imparting a creased portion within the carton or case sealing tape which effectively provides the same with an enhanced amount of longitudinal rigidity and thereby effectively preventing the same from folding over upon itself such that opposite portions thereof do not become adhered to each other.

4. The tape guide plate and finger plate assembly as set forth in claim 3, wherein:

said at least one roller disposed upon said finger plate comprises a pair of oppositely disposed rollers, mounted upon said finger plate, for engaging portions of said tape guide plate which are disposed upon opposite sides of said centrally located bump.

5. The tape guide plate and finger plate assembly as set forth in claim 4, wherein:

said oppositely disposed rollers are engaged with first and second portions of said tape guide plate disposed upon opposite sides of said centrally located bump of said tape guide plate so as to cooperate with said centrally located bump of said tape guide plate in order to define the creased portion of the carton or case sealing tape.

6. The tape guide plate and finger plate assembly as set forth in claim 1, wherein:

said tape guide plate has a centrally located protrusion disposed thereon for imparting a bowed portion within the carton or case sealing tape which effectively provides the same with an enhanced amount of longitudinal rigidity and thereby effectively preventing the same from folding over upon itself such that opposite portions thereof do not become adhered to each other.

7. The tape guide plate and finger plate assembly as set forth in claim 6, wherein:

said at least one roller disposed upon said finger plate comprises a pair of oppositely disposed rollers, mounted upon said finger plate, for engaging portions of said tape guide plate which are disposed upon opposite sides of said centrally located protrusion.

8. The tape guide plate and finger plate assembly as set forth in claim 7, wherein:

said oppositely disposed rollers are engaged with first and second portions of said tape guide plate disposed upon opposite sides of said centrally located protrusion of said tape guide plate so as to cooperate with said centrally located protrusion of said tape guide plate in order to define the bowed portion of the carton or case sealing tape.

9. The tape guide plate and finger plate assembly as set forth in claim 1, wherein:

said at least one roller disposed upon said finger plate comprises a pair of oppositely disposed rollers.

10. The tape guide plate and finger plate assembly as set forth in claim 1, wherein:

said spring is interposed between an application roller arm, supporting said sealing tape application roller, and said tape guide plate for pushing a portion of said tape guide plate away from said application roller arm so as to bias said tape guide plate toward and into engagement with said finger plate; and a second spring interposed between said application roller arm and said finger plate for pushing a portion of said finger plate away from said application roller arm so as to bias said finger plate toward and into engagement with said tape guide plate such that said tape guide plate and said finger plate operatively cooperate together in order to guide the leading end portion of the carton or case sealing tape toward said sealing tape application roller.

11. A carton or case sealing machine, comprising:

a sealing tape application roller;

a tape guide plate;

a finger plate pivotally mounted at a first proximal end portion thereof, and having at least one finger disposed upon a second distal end portion thereof;

a spring for biasing said finger plate toward said tape guide plate such that said at least one finger of said finger plate is moved into engagement with said tape guide plate such that a leading end portion of the carton or case sealing tape is interposed and conveyed between said tape guide plate and said at least one finger of said finger plate and guided toward said sealing tape application roller; and at least one roller disposed upon said at least one finger of said finger plate and operatively engaged with said tape guide plate for smoothly guiding the leading end portion of the carton or case sealing tape toward said sealing tape application roller for deposition onto a surface portion of a carton or case to be sealed, as the sealing tape is conveyed between said at least one roller, mounted upon said at least one finger of said finger plate, and said tape guide plate.

12. The carton or case sealing machine as set forth in claim 11, wherein:

said tape guide plate has a centrally located bump isposed thereon for imparting a creased portion within the carton or case sealing tape which effectively provides the same with an enhanced amount of longitudinal rigidity and thereby effectively preventing the same from folding over upon itself such that opposite portions thereof do not become adhered to each other.

13. The carton or case sealing machine as set forth in claim 12, wherein:

said at least one roller disposed upon said finger plate comprises a pair of oppositely disposed rollers, mounted upon said finger plate, for engaging portions of said tape guide plate which are disposed upon opposite sides of said centrally located bump.

14. The carton or case sealing machine as set forth in claim 13, wherein:

said oppositely disposed rollers are engaged with first and second portions of said tape guide plate disposed upon opposite sides of said centrally located bump of said tape guide plate so as to cooperate with said centrally located bump of said tape guide plate in order to define the creased portion of the carton or case sealing tape.

15. The carton or case sealing machine as set forth in claim 11, wherein:

said tape guide plate has a centrally located protrusion disposed thereon for imparting a bowed portion within the carton or case sealing tape which effectively provides the same with an enhanced amount of longitudinal rigidity and thereby effectively preventing the same from folding over upon itself such that opposite portions thereof do not become adhered to each other.

16. The carton or case sealing machine as set forth in claim 15, wherein:

said at least one roller disposed upon said finger plate comprises a pair of oppositely disposed rollers, mounted upon said finger plate, for engaging portions of said tape guide plate which are disposed upon opposite sides of said centrally located protrusion.

17. The carton or case sealing machine as set forth in claim 16, wherein:

said oppositely disposed rollers are engaged with first and second portions of said tape guide plate disposed upon opposite sides of said centrally located protrusion of said tape guide plate so as to cooperate with said centrally located protrusion of said tape guide plate in order to define the bowed portion of the carton or case sealing tape.

18. The carton or case sealing machine as set forth in claim 11, wherein:

said at least one roller disposed upon said finger plate comprises a pair of oppositely disposed rollers.

19. The carton or case sealing machine as set forth in claim 11, wherein:

said spring is interposed between an application roller arm, supporting said sealing tape application roller, and said tape guide plate for pushing a portion of said tape guide plate away from said application roller arm so as to bias said tape guide plate toward and into engagement with said finger plate; and a second spring is interposed between said application roller arm and said finger plate for pushing a portion of said finger plate away from said application roller arm so as to bias said finger plate toward and into engagement with said tape guide plate such that said tape guide plate and said finger plate operatively cooperate together in order to guide the leading end portion of the carton or case sealing tape toward said sealing tape application roller.

* * * * *